US009771179B2

(12) United States Patent
Clark et al.

(10) Patent No.: US 9,771,179 B2
(45) Date of Patent: Sep. 26, 2017

(54) PALLET ASSEMBLY

(71) Applicant: Rehrig Pacific Company, Los Angeles, CA (US)

(72) Inventors: Suzanne Whitfield Clark, Santa Monica, CA (US); Dane Gin Mun Kalinowski, Irvine, CA (US); Jon P. Hassell, Atlanta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 15/200,133

(22) Filed: Jul. 1, 2016

(65) Prior Publication Data

US 2017/0001755 A1 Jan. 5, 2017

Related U.S. Application Data

(60) Provisional application No. 62/187,988, filed on Jul. 2, 2015.

(51) Int. Cl.

| | |
|---|---|
| ***B65D 19/04*** | (2006.01) |
| ***B65D 19/44*** | (2006.01) |
| ***B65D 19/00*** | (2006.01) |

(52) U.S. Cl.

CPC ..... *B65D 19/44* (2013.01); *B65D 19/0036* (2013.01); *B65D 19/04* (2013.01); *B65D 2519/00024* (2013.01); *B65D 2519/00034* (2013.01); *B65D 2519/00069* (2013.01); *B65D 2519/00129* (2013.01); *B65D 2519/00149* (2013.01); *B65D 2519/00273* (2013.01); *B65D 2519/00288* (2013.01); *B65D 2519/00318* (2013.01); *B65D 2519/00343* (2013.01); *B65D 2519/00437* (2013.01); *B65D 2519/00796* (2013.01); *B65D 2519/00805* (2013.01); *B65D 2519/00815* (2013.01)

(58) Field of Classification Search

CPC ..... B65D 19/44; B65D 19/04; B65D 19/06; B65D 19/08; B65D 19/38; B65D 19/42; B65D 2519/00024; B65D 25/10; B65D 23/108

See application file for complete search history.

(56) References Cited

U.S. PATENT DOCUMENTS

| | | | | |
|---|---|---|---|---|
| 5,787,817 A * | 8/1998 | Heil | B65D 19/44 | 108/51.11 |
| 6,360,676 B1 * | 3/2002 | Schepers | B65D 19/0095 | 108/52.1 |
| 6,539,881 B2 * | 4/2003 | Underbrink | B65D 19/42 | 108/55.3 |

(Continued)

FOREIGN PATENT DOCUMENTS

| | | |
|---|---|---|
| WO | 2004037662 | 5/2004 |

*Primary Examiner* — Daniel Rohrhoff

(74) *Attorney, Agent, or Firm* — Carlson, Gaskey & Olds PC

(57) ABSTRACT

A pallet includes an upper portion which includes an upper surface. A plurality of columns extend downwardly from the upper portion. A plurality of channels extend across the upper surface of the upper portion. A plurality of cavities form openings through the upper portion and a corresponding one of the plurality of columns. The plurality of cavities are aligned with at least one of the plurality of channels.

17 Claims, 22 Drawing Sheets

(56) References Cited

U.S. PATENT DOCUMENTS

| | | | | |
|---|---|---|---|---|
| 2006/0013991 | A1* | 1/2006 | Hoogland | B65D 19/0048 428/119 |
| 2007/0137532 | A1* | 6/2007 | Cromie | B65D 19/42 108/57.15 |
| 2009/0218244 | A1* | 9/2009 | Banik | B65D 19/38 206/386 |
| 2013/0119623 | A1* | 5/2013 | Sadeh | B62B 5/049 280/30 |
| 2014/0366783 | A1* | 12/2014 | Kosonen | B65D 19/0002 108/51.11 |

* cited by examiner

PALLET ASSEMBLY

RELATED APPLICATIONS

This application claims the benefit of U.S. Provisional Application No. 62/187,988, filed Jul. 2, 2015.

BACKGROUND

Pallets are often used to transport goods. Pallets may include an upper deck supported above the floor so that the tines of a forklift or pallet lift jack can be inserted below the deck to lift the pallet and goods. The goods can be stacked directly on the pallet or placed on stackable trays. The stackable trays can be placed directly on the pallet for transport with or without goods stacked thereon.

SUMMARY

In one exemplary embodiment, a pallet includes an upper portion which includes an upper surface. A plurality of columns extend downwardly from the upper portion. A plurality of channels extend across the upper surface of the upper portion. A plurality of cavities form openings through the upper portion and a corresponding one of the plurality of columns. The plurality of cavities are aligned with at least one of the plurality of channels.

In another exemplary embodiment, a storage assembly includes a pallet which includes an upper portion that has an upper surface. A plurality of columns extend downwardly from the upper portion. A plurality of channels extend across the upper surface of the upper portion. A plurality of cavities form openings through the upper portion and a corresponding one of the plurality of columns. The plurality of cavities are aligned with at least one of the plurality of channels. A fixture includes an upper surface located on a first side of the fixture. A plurality of plugs extend upward from the upper surface of the fixture. The plurality of plugs are configured to be received within a corresponding one of the plurality of cavities.

In another exemplary embodiment, a method of transporting storage components comprising the step of aligning a pallet that has a plurality of cavities that extend through the pallet on a fixture that has a plurality of plugs that each correspond to a location of the plurality of cavities that extend through the pallet. A wheel is aligned on a dolly with one of the cavities in the pallet. The wheel is supported on the dolly with the plug on the fixture. The pallet is separated from the fixture such that the wheel on the dolly becomes recessed in a corresponding one of the cavities in the pallet.

DETAILED DESCRIPTION

Figure 1:
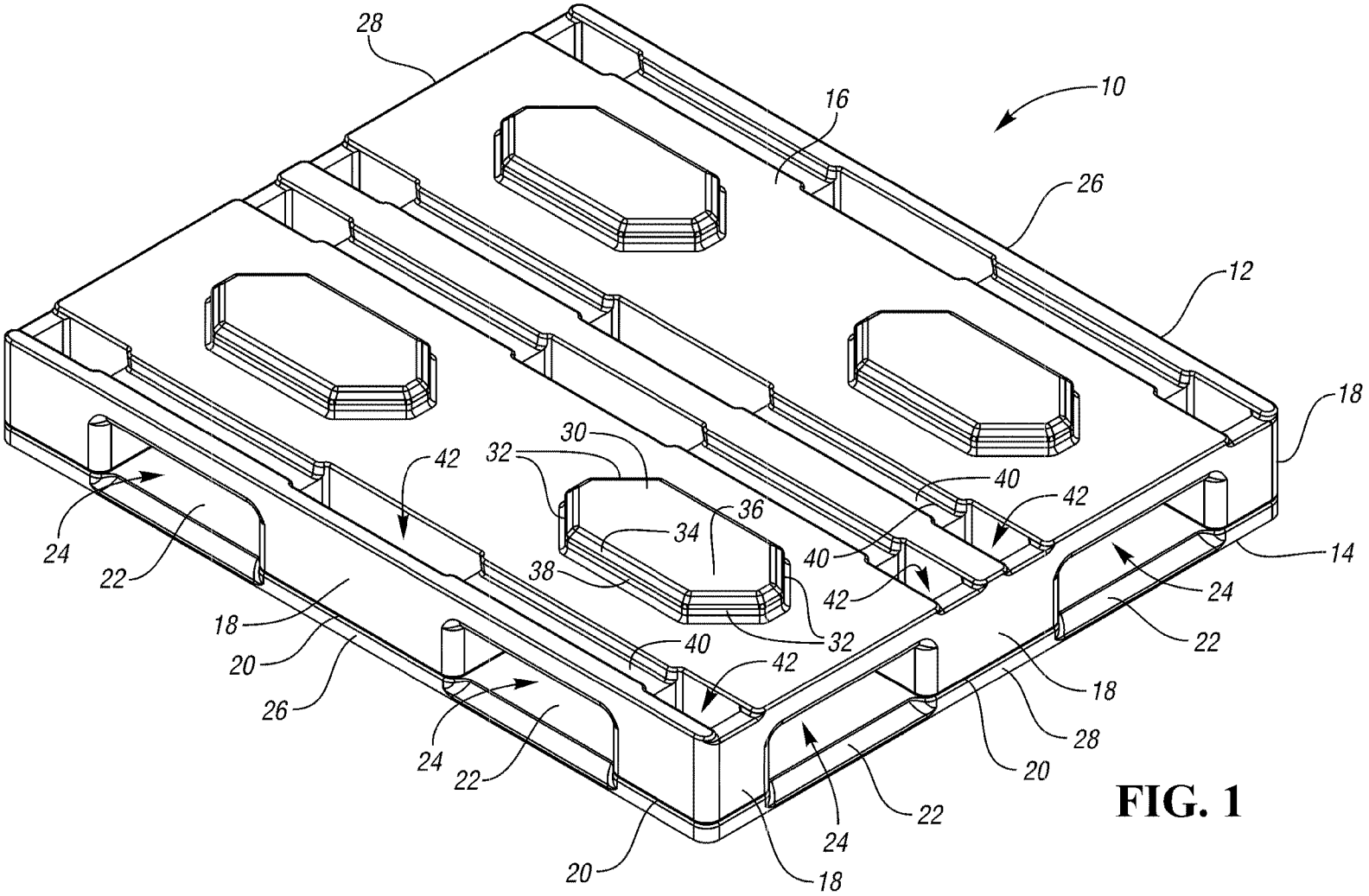
FIG. 1 is a perspective view of a pallet according to a first embodiment.

An example pallet assembly 10 is shown in FIG. 1. The pallet assembly 10 includes an upper portion 12 and a lower portion 14. In the illustrated example, the upper portion 12 and the lower portion 14 are each rotationally molded as individual pieces. Alternatively, the upper portion 12 and the lower portion 14 could be injection molded as individual pieces. The upper portion 12 includes an upper deck 16 having an upper surface for supporting a dolly thereon. Upper column portions 18 extending downward from the upper deck 16. The lower portion 14 of the pallet assembly 10 includes column receiver portions 20 for accepting the upper column portions 18 and runners 22 extending between the column receiver portions 20.

The pallet assembly 10 includes a pair of side walls 26 and a pair of opposing end walls 28 that each include a pair of fork openings 24 for accepting tines on a fork lift to move the pallet assembly 10.

Figure 2:
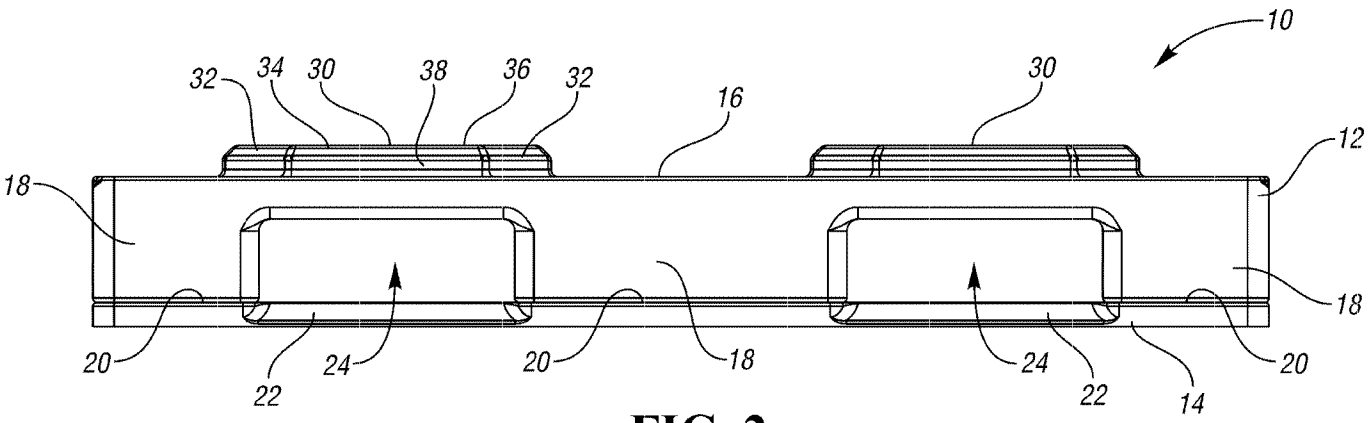
FIG. 2 is a side view of the pallet of FIG. 1.
Figure 3:
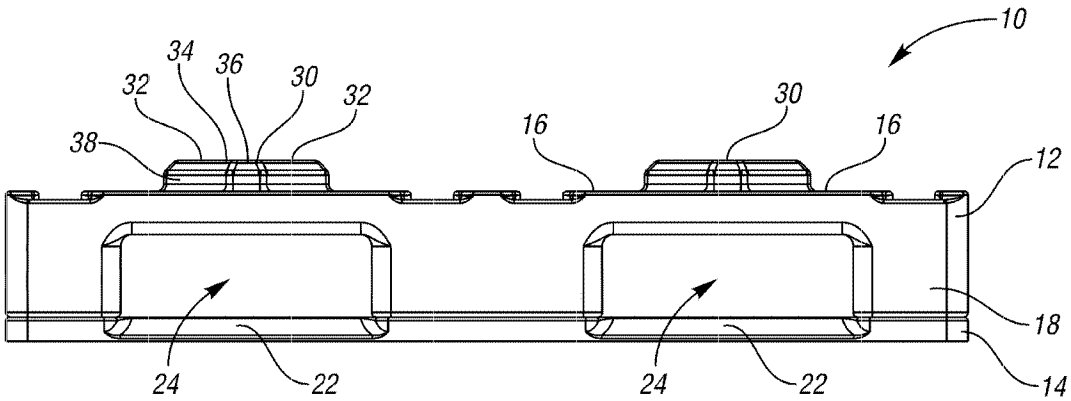
FIG. 3 is an end view of the pallet of FIG. 1.

FIG. 2 illustrates a side view and FIG. 3 illustrates an end view of the pallet assembly 10. The upper deck 16 includes a support structure 30 that extends upward from the upper deck 16 for increasing the rigidity of the upper portion 12 of the pallet assembly 10. As shown in FIGS. 1-3, the support structure 30 extends a first distance in the direction of the side walls 26 and a second distance in the direction of the end walls 28 with the first distance being greater than the second distance. In another example, the second distance could be greater than the first distance. The support structure 30 includes angled corner portions 32 and a curved upper edge 34 between an upper surface 36 and a perimeter wall 38. In another example, the corner portions could be rounded and the upper edge 34 could be angled.

Figure 4:
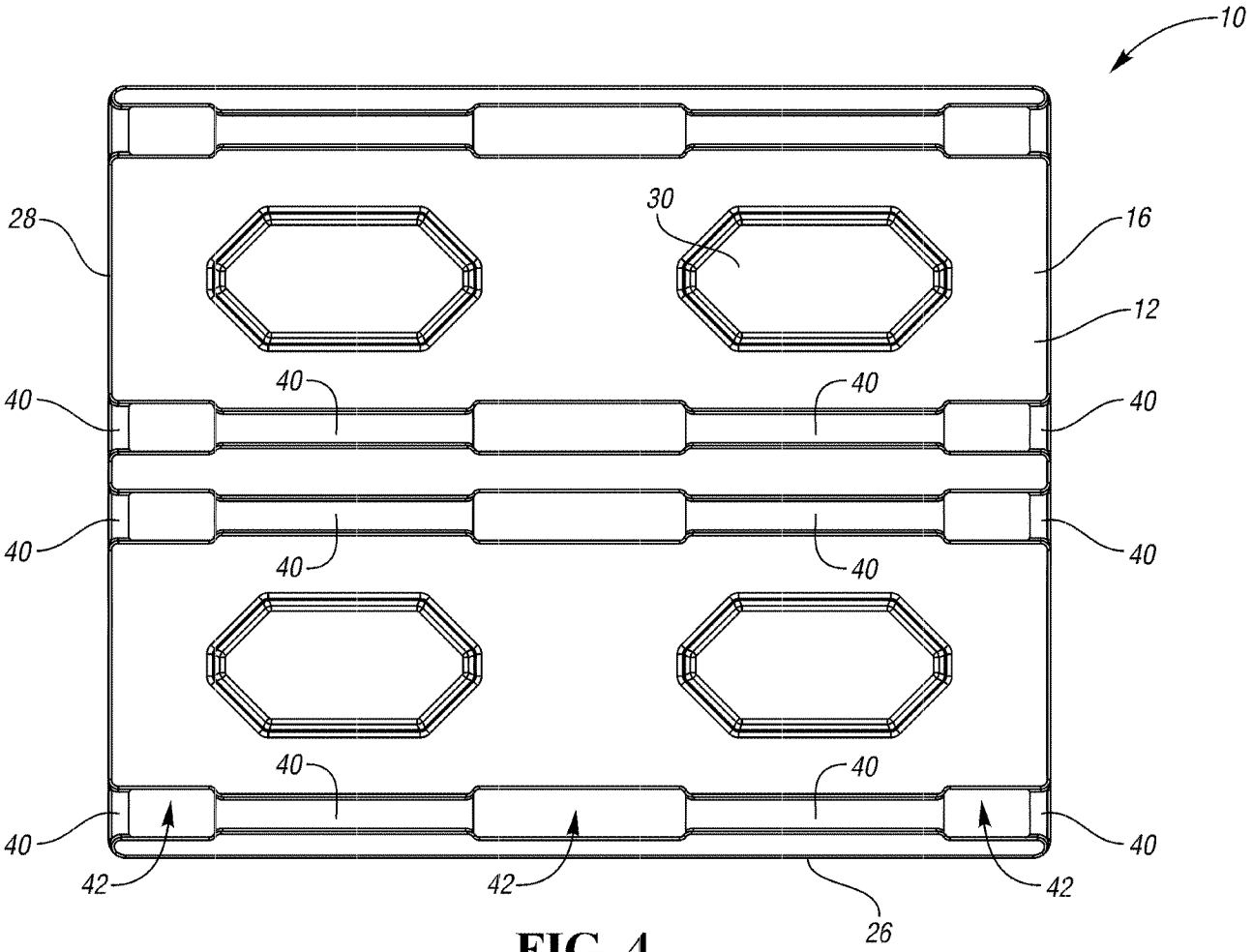
FIG. 4 is a top view of the pallet of FIG. 1.

FIG. 4 illustrates a top view of the pallet assembly 10 including channels 40 separated by cavities 42 that form discontinuities in the channels 40. The channels 40 extend in a direction parallel to the side walls 26 and perpendicular to the end walls 28 to allow entry into the channels 40 from either end wall 28. In another example 40, the channels 40 extend in a direction parallel to the end walls 28 and perpendicular to the side walls 26. The cavities 42 extend through the upper portion 12 and the lower portion 14 through the upper column portions 18 to form an opening extending through the pallet assembly 10.

Figure 5:
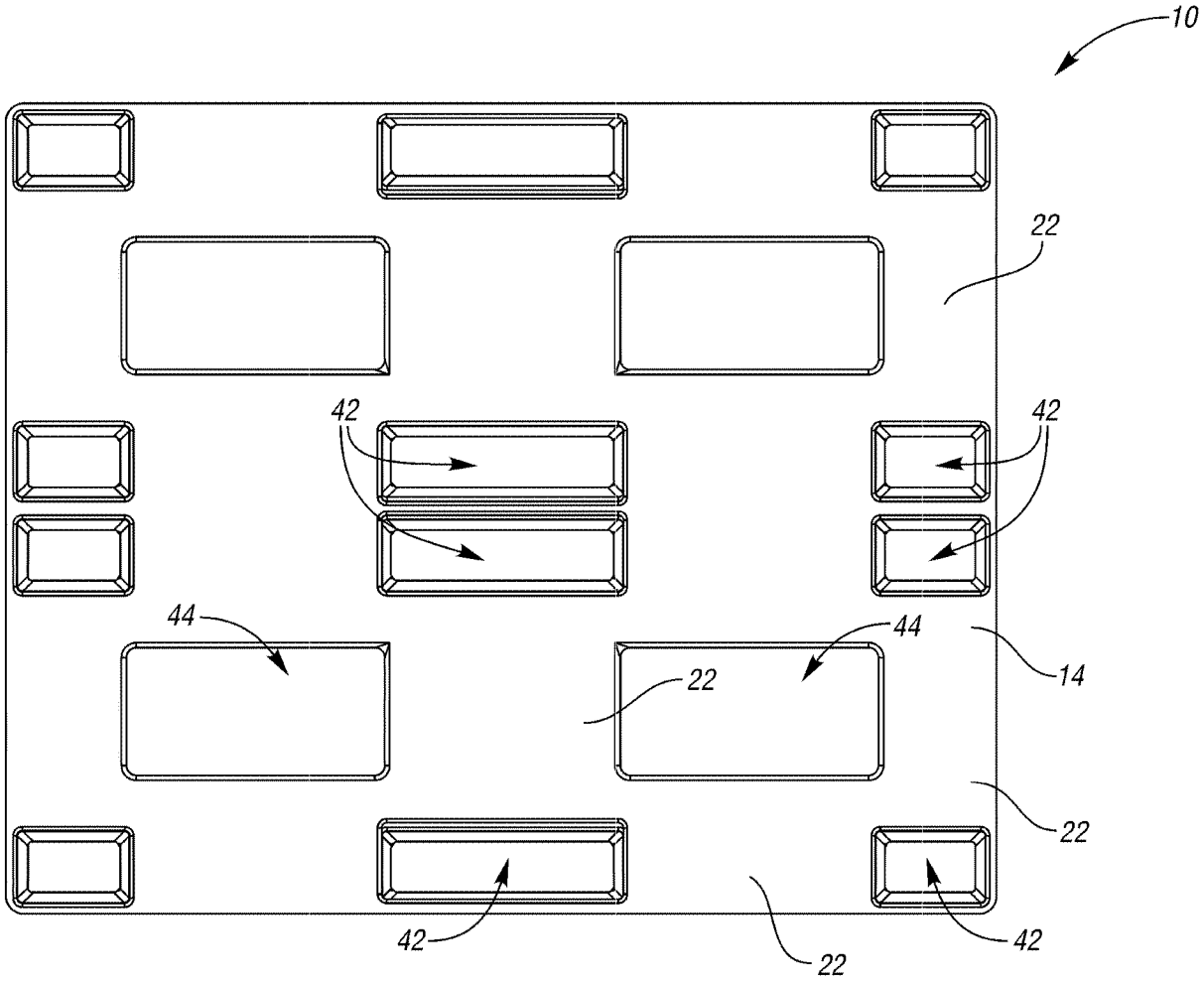
FIG. 5 is a bottom view of the pallet of FIG. 1.

FIG. 5 illustrates a bottom view of the pallet assembly 10. The cavities 42 form openings extending through the lower portion 14. The runners 22 define runner openings 44 extending through the lower portion 14 which reduces the weight of the lower portion 14 by reducing the amount of material in the lower portion 14 while also contributing to the rigidity of the lower portion 14.

Figure 6:
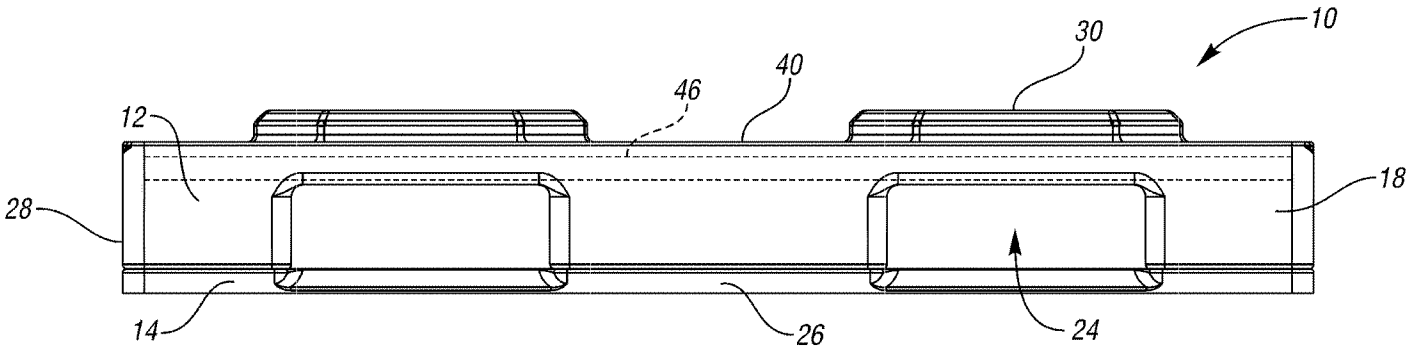
FIG. 6 is a side view of the pallet of FIG. 1 illustrating a reinforcement member.
Figure 7:
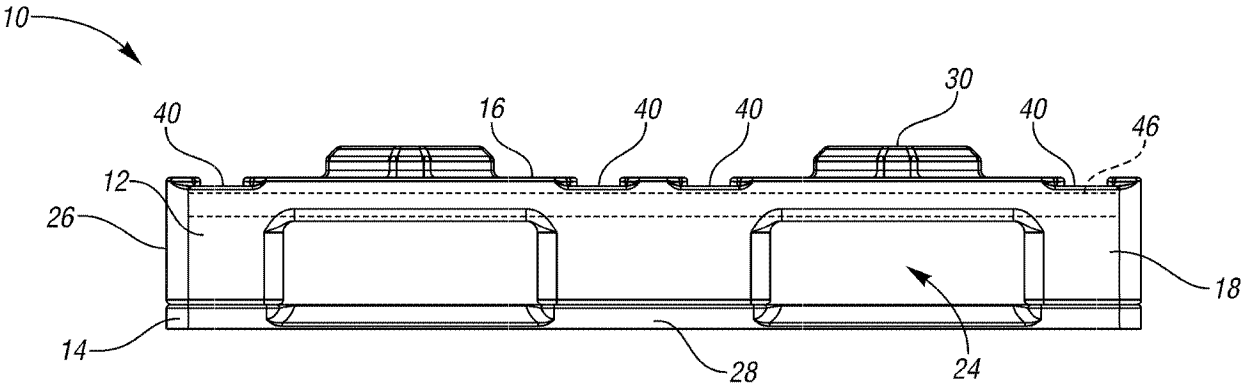
FIG. 7 is an end view of the pallet of FIG. 1 illustrating a reinforcement member.
Figure 8:
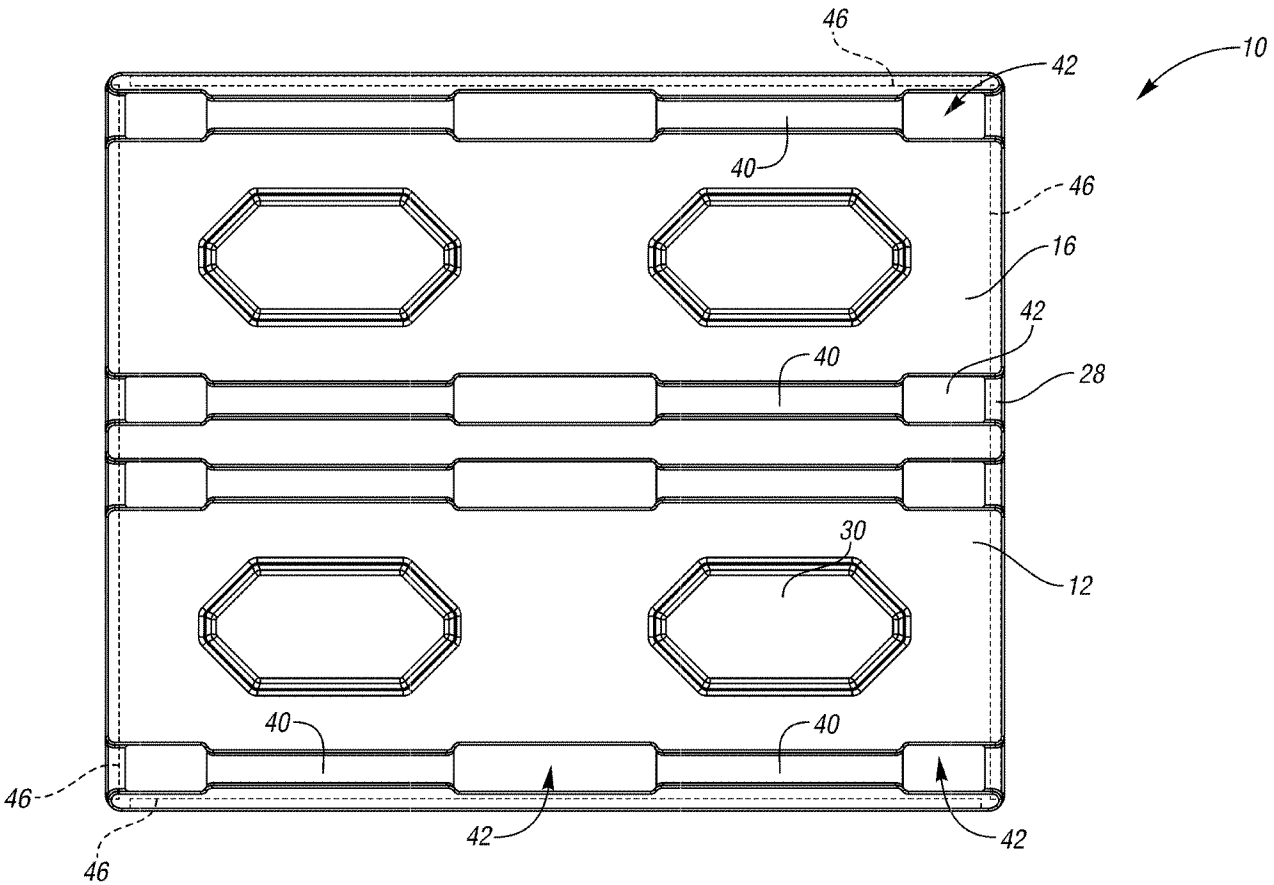
FIG. 8 is a top view of the pallet of FIG. 1 illustrating the reinforcement members.

FIGS. 6-8 illustrate reinforcement members 46 located in the upper portion 12 between the upper deck 16 and the fork openings 24. In one example, the reinforcement members 46 are made of metal, such as steel or aluminum, and in another example, the reinforcement members 46 are made of a reinforced composite material.

As shown in FIG. 8, the reinforcement members 46 surround a perimeter of the upper portion 12. In the illustrated example, adjacent ends of the reinforcement members 46 are separated or spaced from each other at the corners of the upper portion 12. In another example, the ends of the reinforcement members 46 are secured to an adjacent reinforcement member 46 at the corners of the upper portion 12. The reinforcement members 46 are located inward from an outer perimeter of the upper portion 12 and outward the cavities 42. In another example, the reinforcement members 46 could be located in the lower portion 14 spaced inward from a perimeter of the lower portion 14 and outward from the cavities 42 extending through the lower portion 14.

Figure 9:
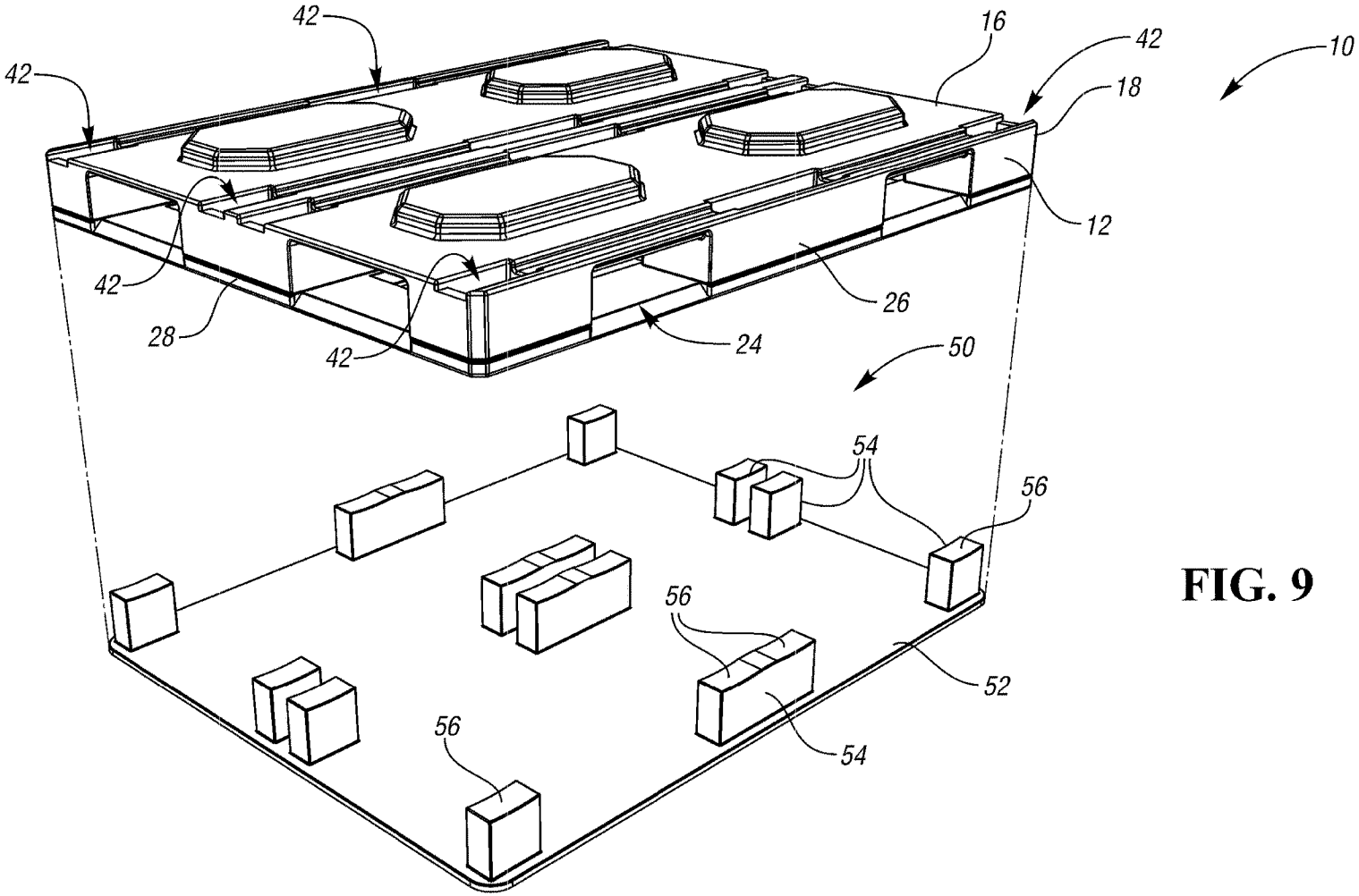
FIG. 9 illustrates the pallet of FIG. 1 in relation to a fixture.

FIG. 9 illustrates the pallet assembly 10 positioned above a fixture 50. The fixture 50 includes a lower surface 52 for supporting the lower portion 14 of the pallet assembly 10 and plugs 54 extending upward from the fixture 50 for slidably engaging a corresponding one of the cavities 42 in the pallet assembly 10. The fixture 50 could be made of a polymer, a composite, or a metallic material.

Figure 10:
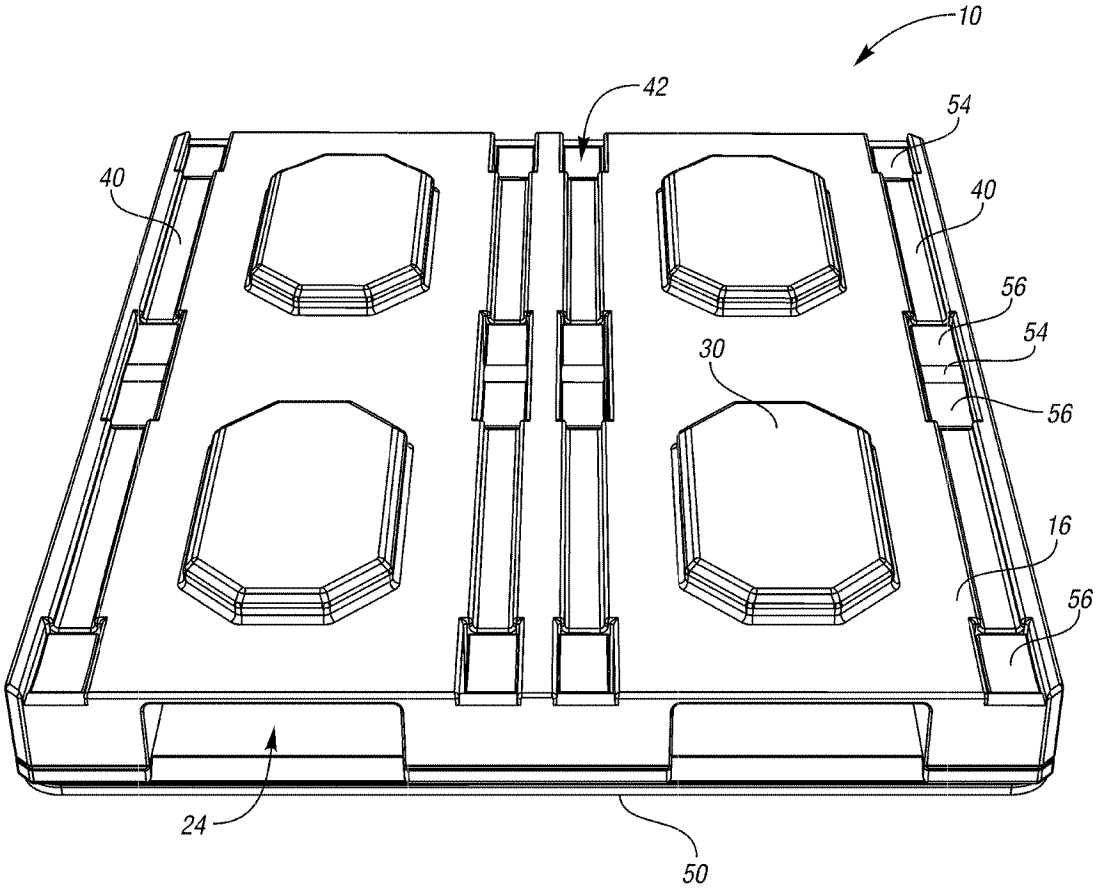
FIG. 10 illustrates the pallet of FIG. 1 located on the fixture.
Figure 11:
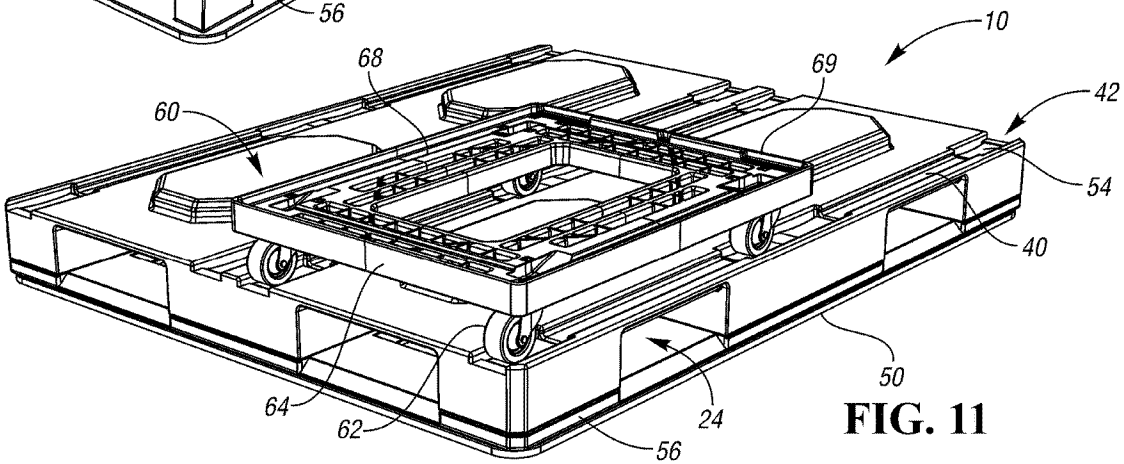
FIG. 11 illustrates the pallet of FIG. 1 located on the fixture and a dolly resting on the fixture and spaced from the pallet.

FIG. 10 illustrates the fixture 50 in engagement with the pallet assembly 10. Each of the plugs 54 is received in a corresponding one of the cavities 42 in order to fill the discontinuities in the channels 40. The plugs 54 allow a dolly 60 having casters 62 to roll through the channels 40 as shown in FIG. 11. The distal ends of the plugs 54 include mating surfaces 56 to restrict movement of the casters 62. In the illustrated example, the mating surfaces 56 are concave to provide a mild restriction to movement of the dolly 60 placed on the pallet assembly 10.

Figure 12:
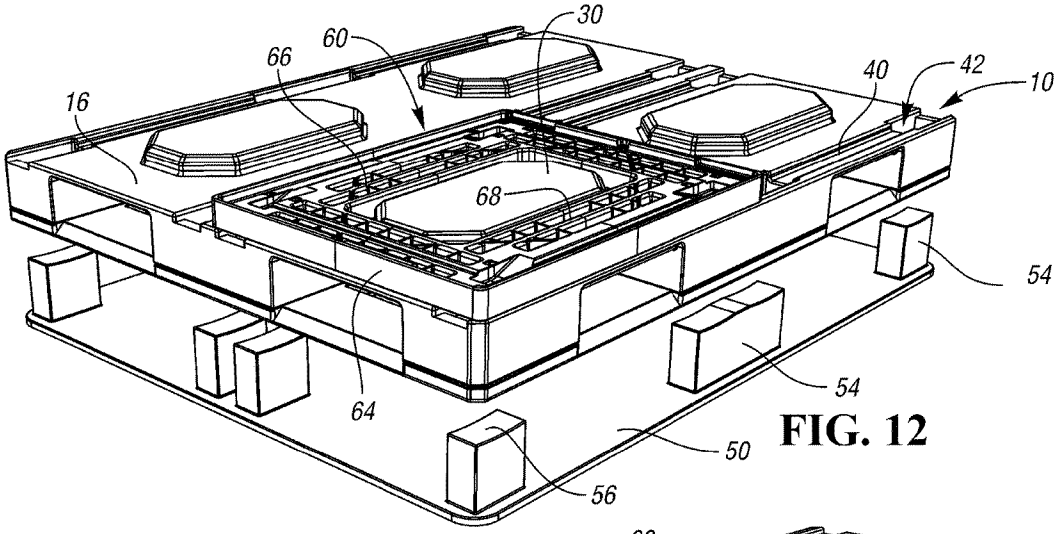
FIG. 12 illustrates the pallet of FIG. 1 spaced from the fixture 50 with a dolly recessed into the pallet.
Figure 13:
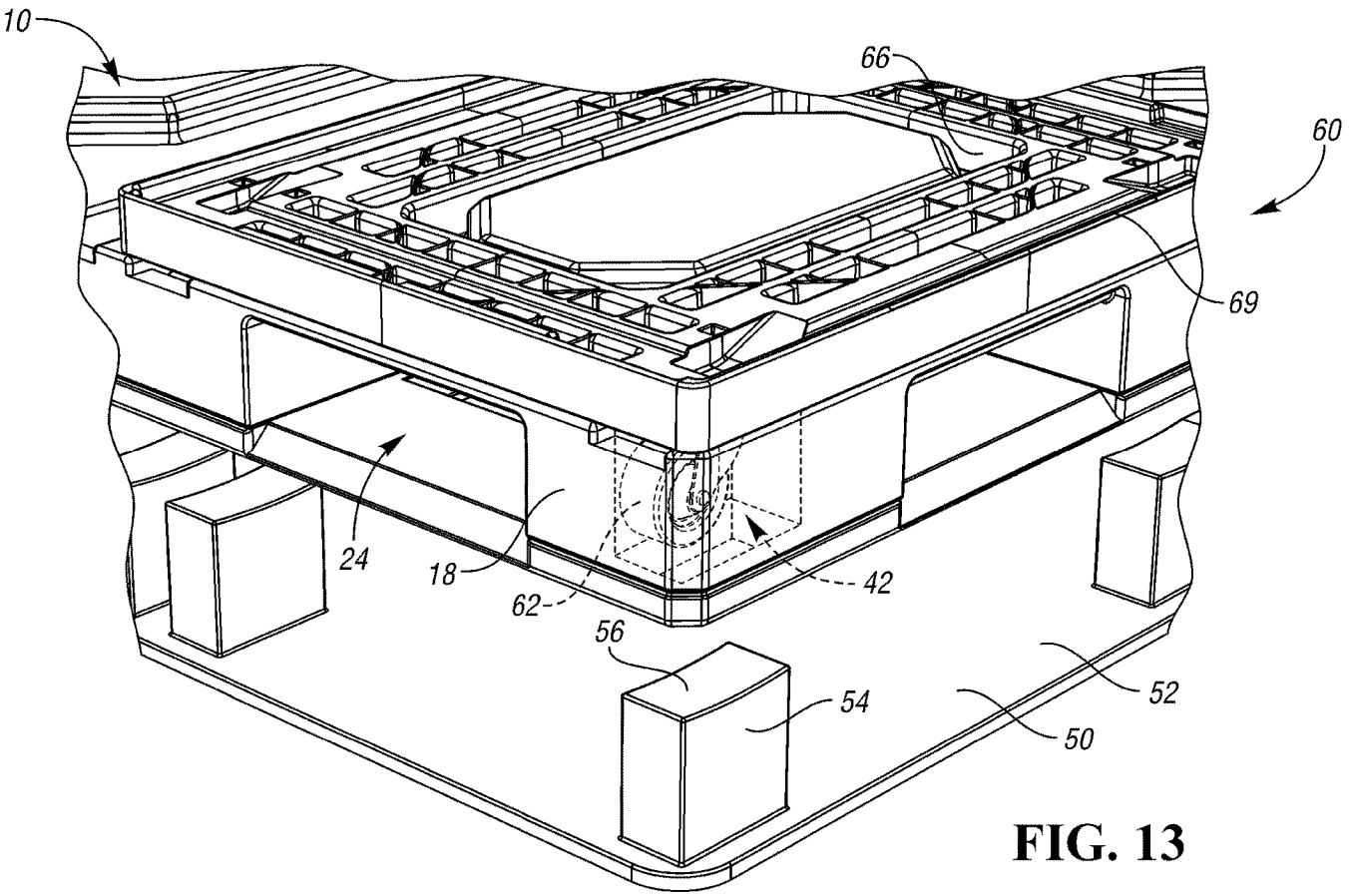
FIG. 13 is an enlarged view of FIG. 12.

As shown in FIGS. 12 and 13, once the pallet assembly 10 is separated from the fixture 50, the casters 62 on the dolly 60 lower into the cavities 42 on the pallet assembly 10 until a lower surface 64 on the dolly 60 contacts the upper deck 16 on the pallet assembly 10. The plugs 54 adjacent a mid-portion of the pallet assembly 10 are sized to accommodate multiple casters 62. In another example, the plugs 54 could be sized to support individual casters 62. The casters 62 do not carry any weight from the dolly 60 when the pallet assembly 10 is removed from the fixture 50. The support structure 30 is received within a central opening 66 in the dolly 60 to locate the dolly 60 relative to the pallet assembly 10 and increase the rigidity of the upper portion 12 of the pallet assembly 10.

Figure 14:
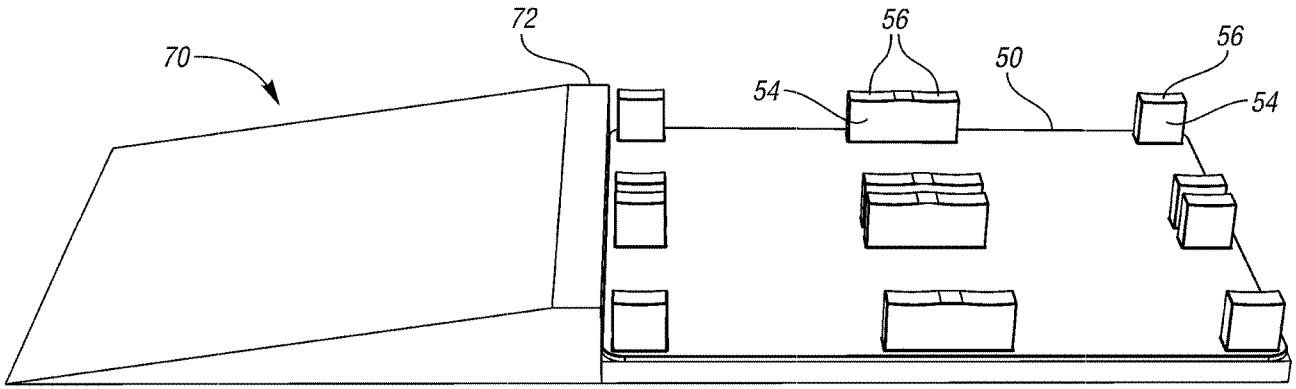
FIG. 14 illustrates the fixture located adjacent a ramp according to a first embodiment.
Figure 15:
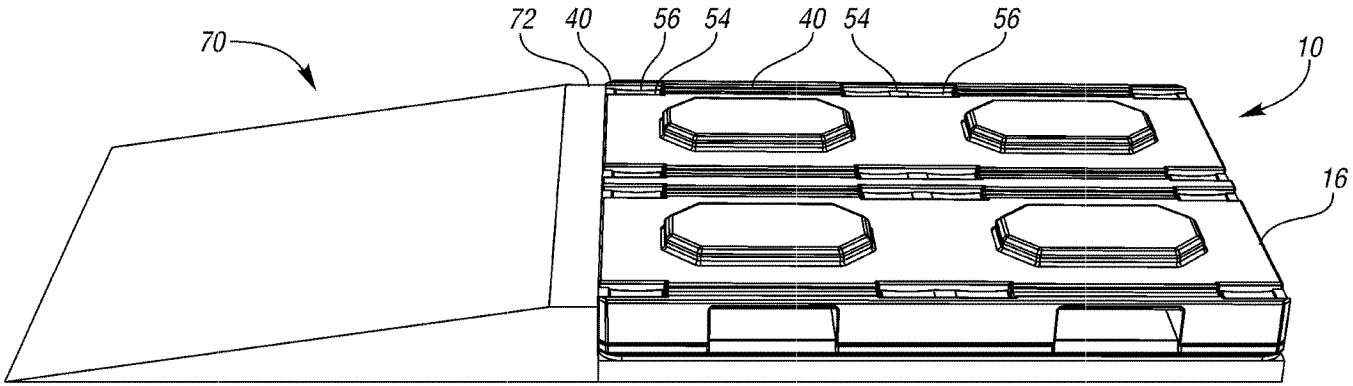
FIG. 15 illustrates the fixture located adjacent the ramp and the pallet of FIG. 1 located on the fixture.
Figure 16:
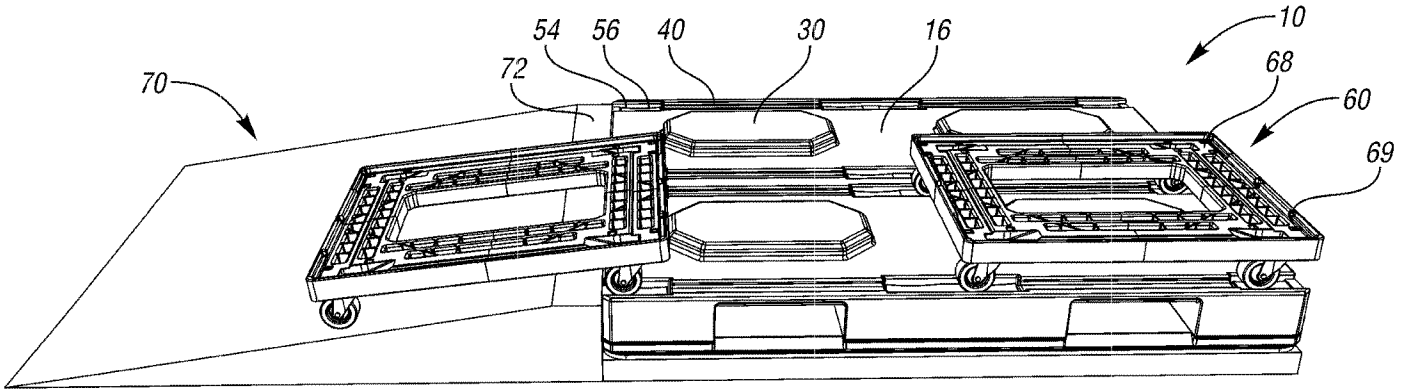
FIG. 16 illustrates a pair of dollies located on the configuration of FIG. 15.
Figure 17:
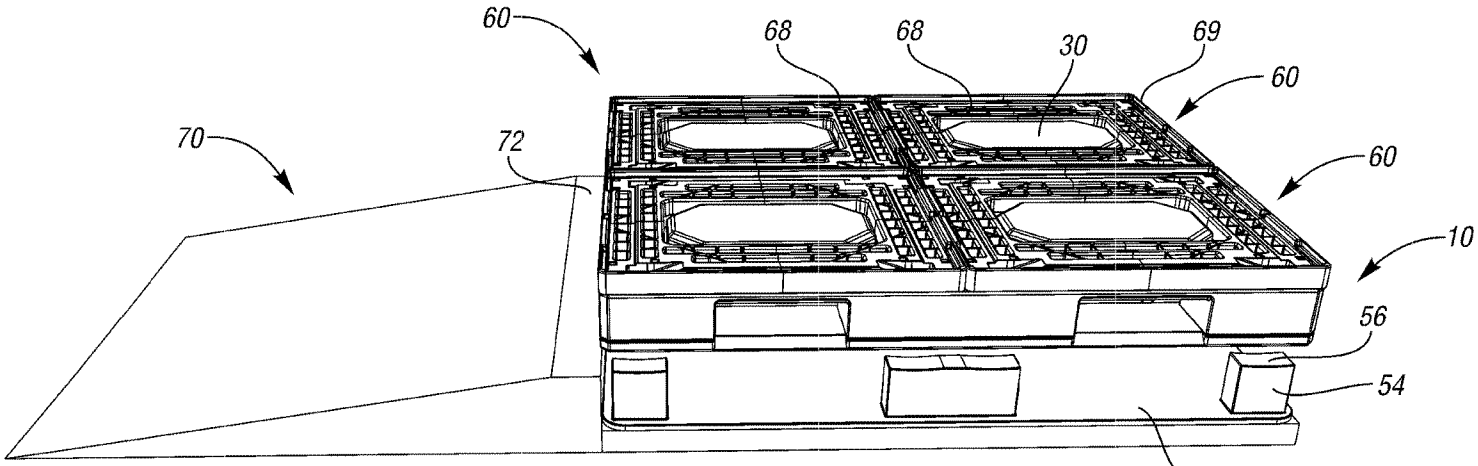
FIG. 17 illustrates four dollies recessed into the pallet of FIG. 1 located adjacent the ramp and the fixture.

FIG. 14 illustrates the fixture 50 located adjacent a ramp 70 and FIG. 15 illustrates the pallet assembly 10 located on the fixture 50 adjacent the ramp 70. The ramp 70 includes an upper surface 72 that is aligned with the channel 40 such that the upper surface 72 is same height as the channel 40 to allow the caster 62 to roll easily from the ramp 70 into the channel 40 as shown in FIG. 16. In the illustrated example, the pallet assembly 10 is sized to accommodate four dollies 60, however, the pallet assembly 10 could be configured to accept more or less than four dollies 60. As shown in FIG. 17, once the pallet assembly is loaded with four dollies 60, the pallet assembly 10 with the dollies 60 can be lifted off of the fixture 50 and the four dollies 60 lower into the pallet assembly 10 in unison.

Figure 18:
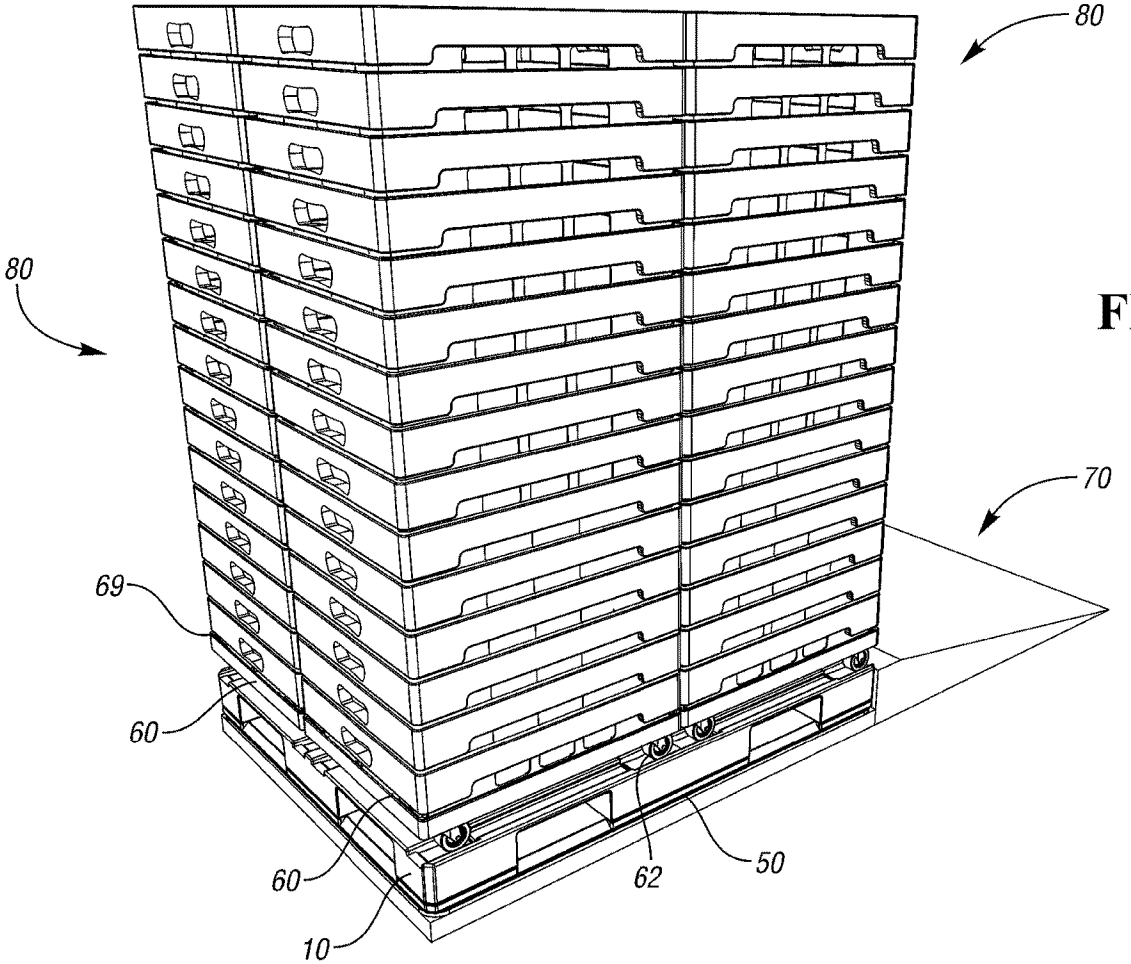
FIG. 18 illustrates multiple pallets of FIG. 1 recessed onto the fixture adjacent the ramp with a stack of trays on each of the pallets.

FIG. 18 illustrates the dollies 60 shown in FIG. 17 each loaded with trays 80. The trays 80 are received on an upper surface 68 of the dollies 60 and at least partially retained by a perimeter ledge 69 surrounding a perimeter of each of the dollies 60.

Figure 19:
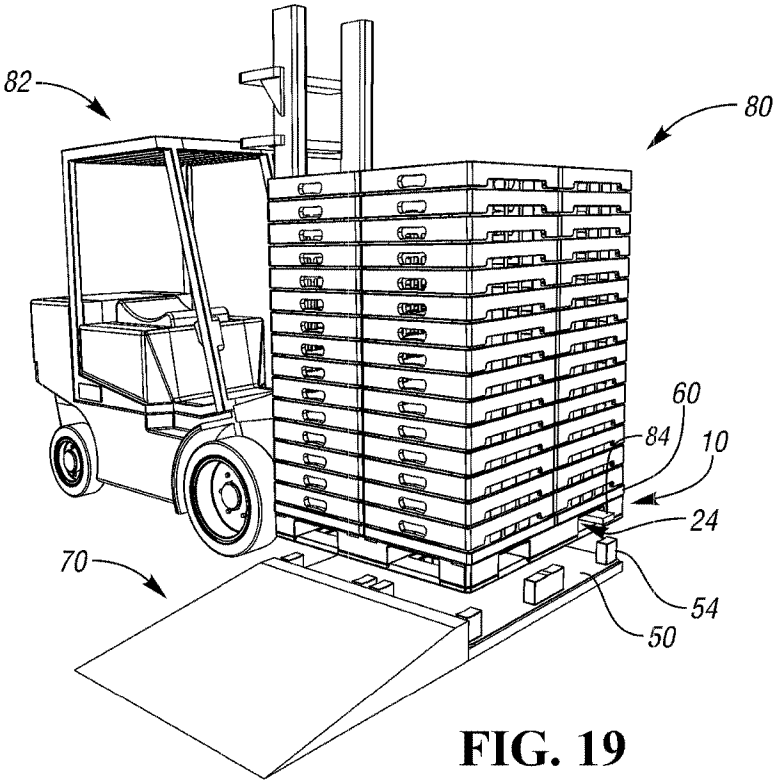
FIG. 19 illustrates a fork lift separating the pallet of FIG. 1 from the fixture with dollies located on the pallet and a stack of trays on each dolly.
Figure 20:
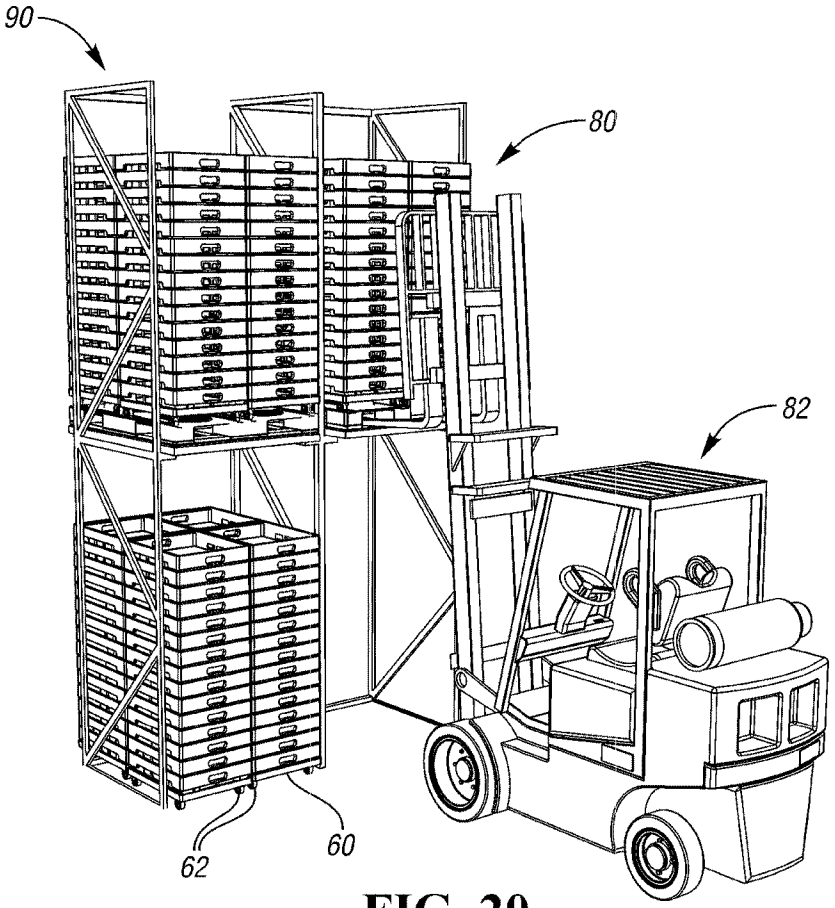
FIG. 20 illustrates the fork lift storing the pallet of FIG. 1 with dollies and trays stacked on the pallet.

Once the pallet assembly 10 is fully loaded with dollies 60 and trays 80, a fork lift 82 can engage the fork openings 24 in the pallet assembly 10 with tines 84 to lift the pallet assembly 10 off of the fixture 50 as shown in FIG. 19. While the fork lift 82 is lifting the pallet assembly 10 off of the fixture 50, the casters 62 on the dollies 60 will lower into the cavities 42. As shown in FIG. 20, the fork lift 82 can then transport the pallet assembly 10 with the dollies 60 and the trays 80 in a storage system 90, such as a shelf or rack, for later use.

Figure 22:
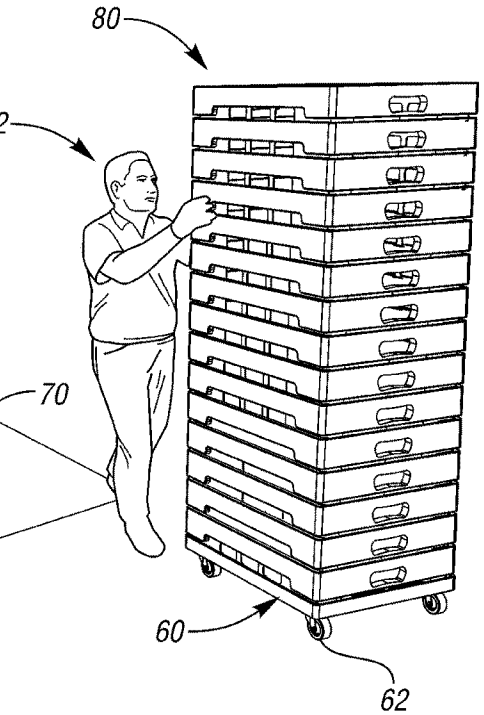
FIG. 22 illustrates the user moving the dolly on casters.
Figure 21:
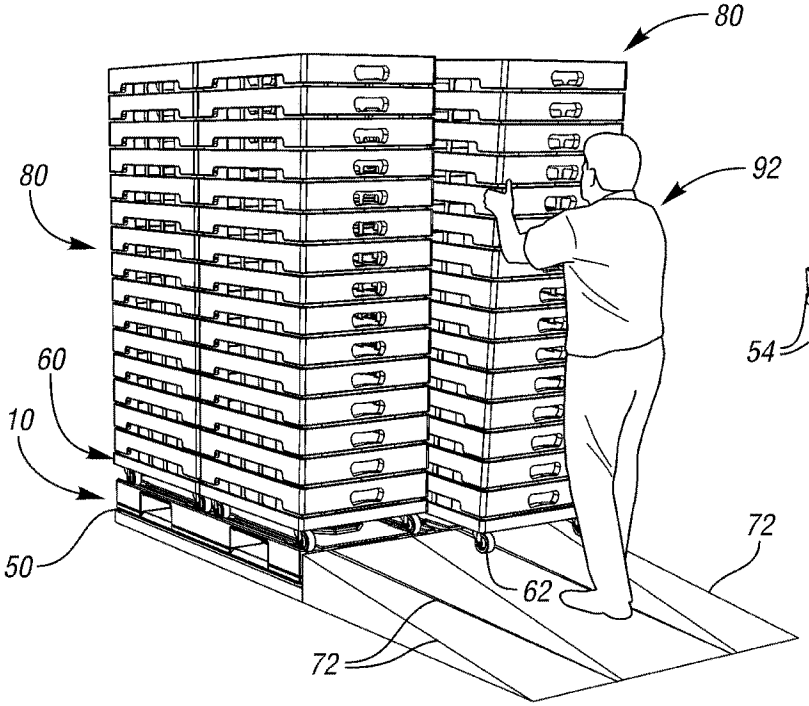
FIG. 21 illustrates a user rolling the dolly stack with trays down the ramp.
Figure 24:
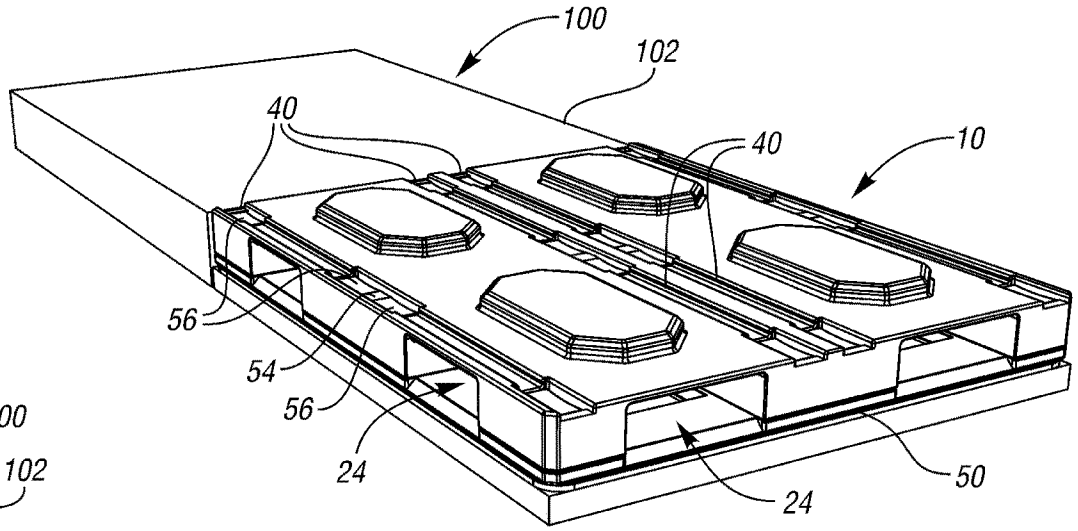
FIG. 24 illustrates the fixture located on the ramp of FIG. 23 and the pallet of FIG. 1 located on fixture.

When the trays 80 and dollies 60 are needed, the fork lift 82 can retrieve the trays 80 and dollies 60 on the pallet assembly 10 from the storage system 90 and lower the pallet assembly 10 onto the fixture 50. The plugs 54 on the fixture 50 raise the casters 62 out of the cavities 42 to align the mating surfaces 56 on the plugs 54 with the channels 40 in the upper deck 16. A user 92 can then remove the trays 80 on the dollies 60 by rolling the casters 62 out of the channels 40 and down the ramp 70 for use as shown in FIGS. 21-22. As shown in FIG. 21, the ramp 70 may include guide elements 72*a* to aid in directing the casters 62 into the channels 40 when reloading the pallet assembly 10.

Figure 23:
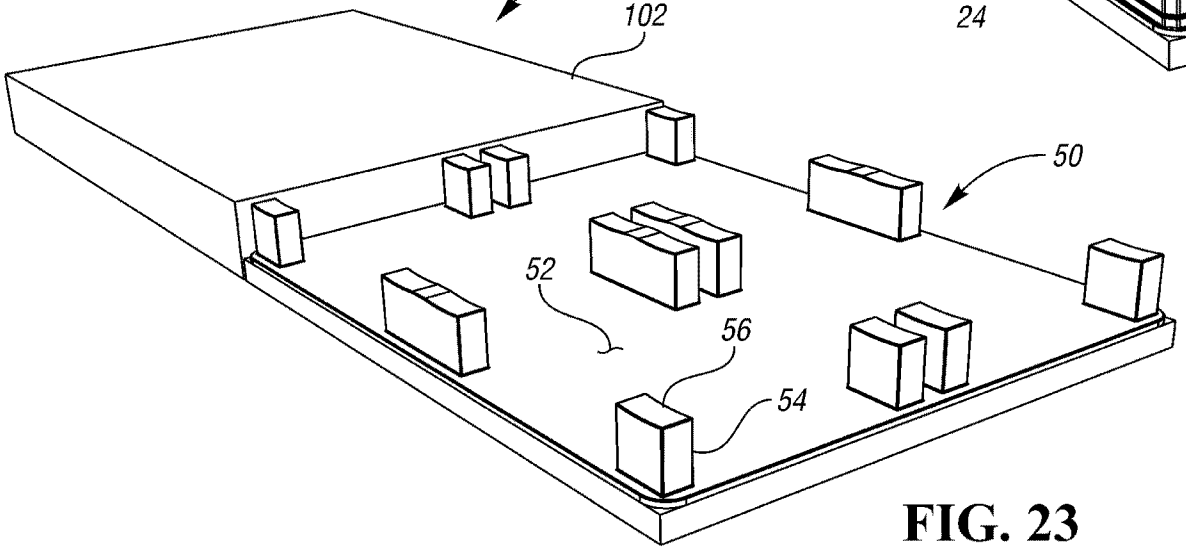
FIG. 23 illustrates a ramp according to a second embodiment with the fixture located adjacent the ramp.
Figure 25:
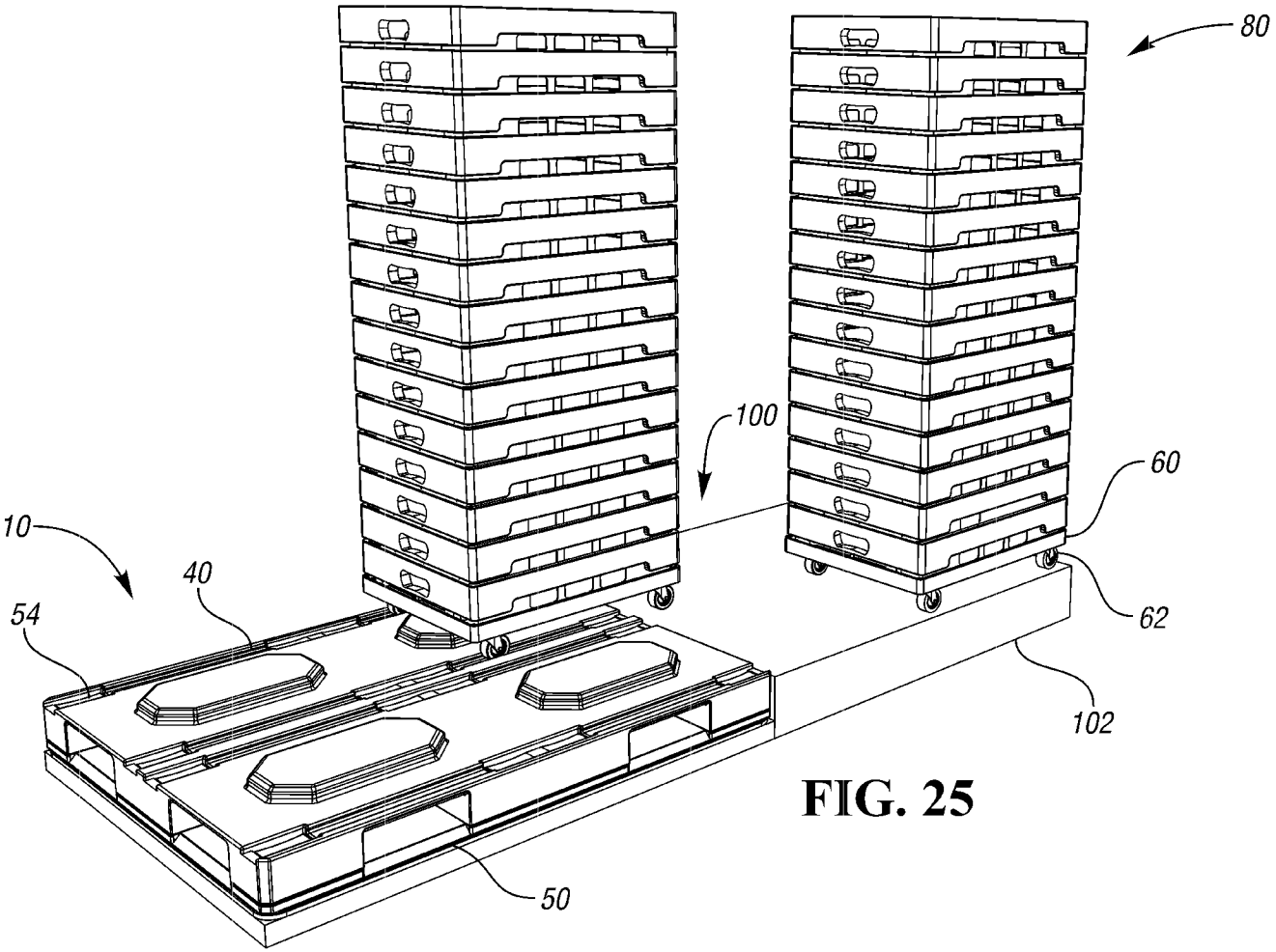
FIG. 25 illustrate dollies moving from the ramp of FIG. 23 onto the pallet of FIG. 1 with the pallet of FIG. 1 located on the fixture.
Figure 26:
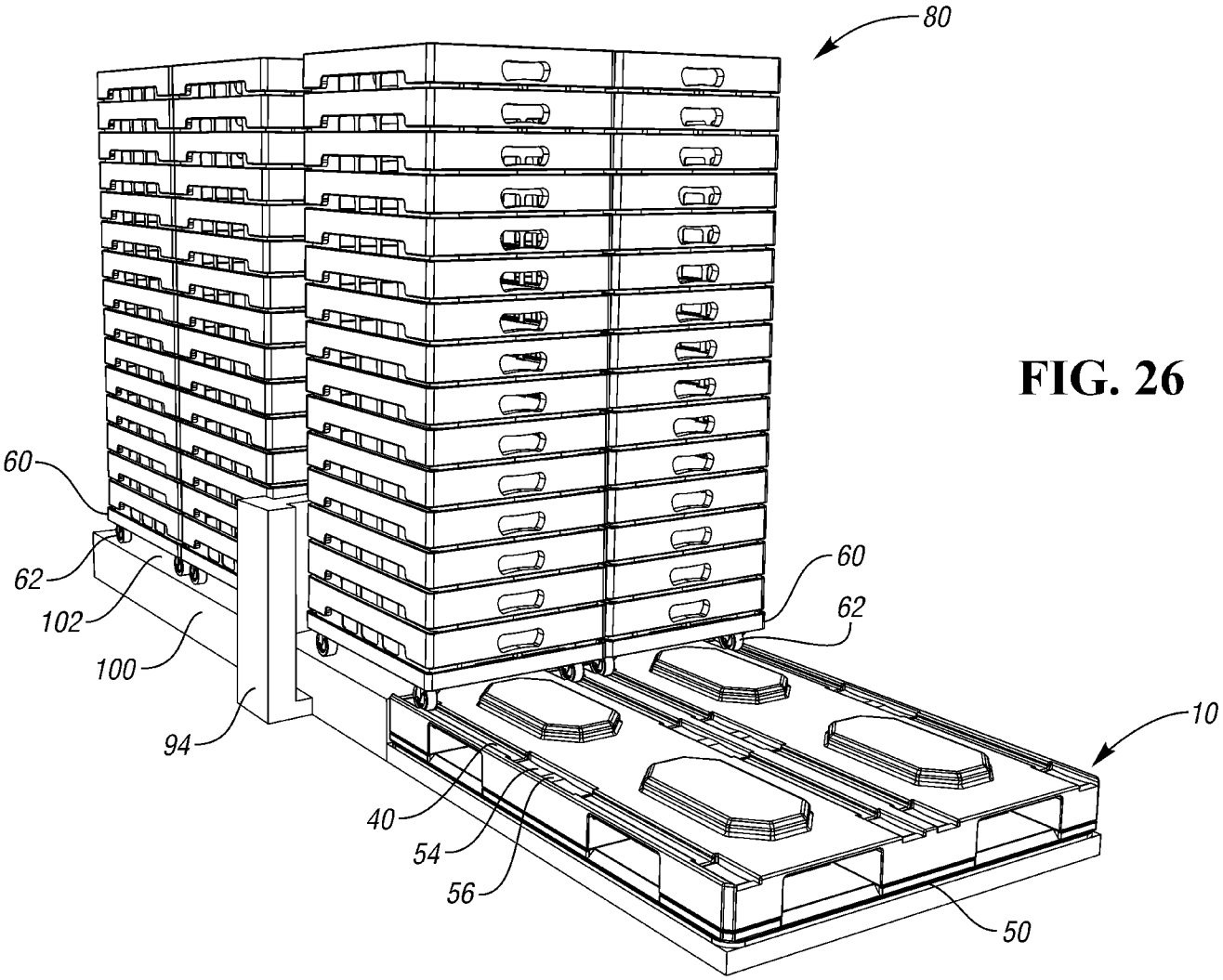
FIG. 26 illustrates an automation system moving dollies loaded with trays.
Figure 27:
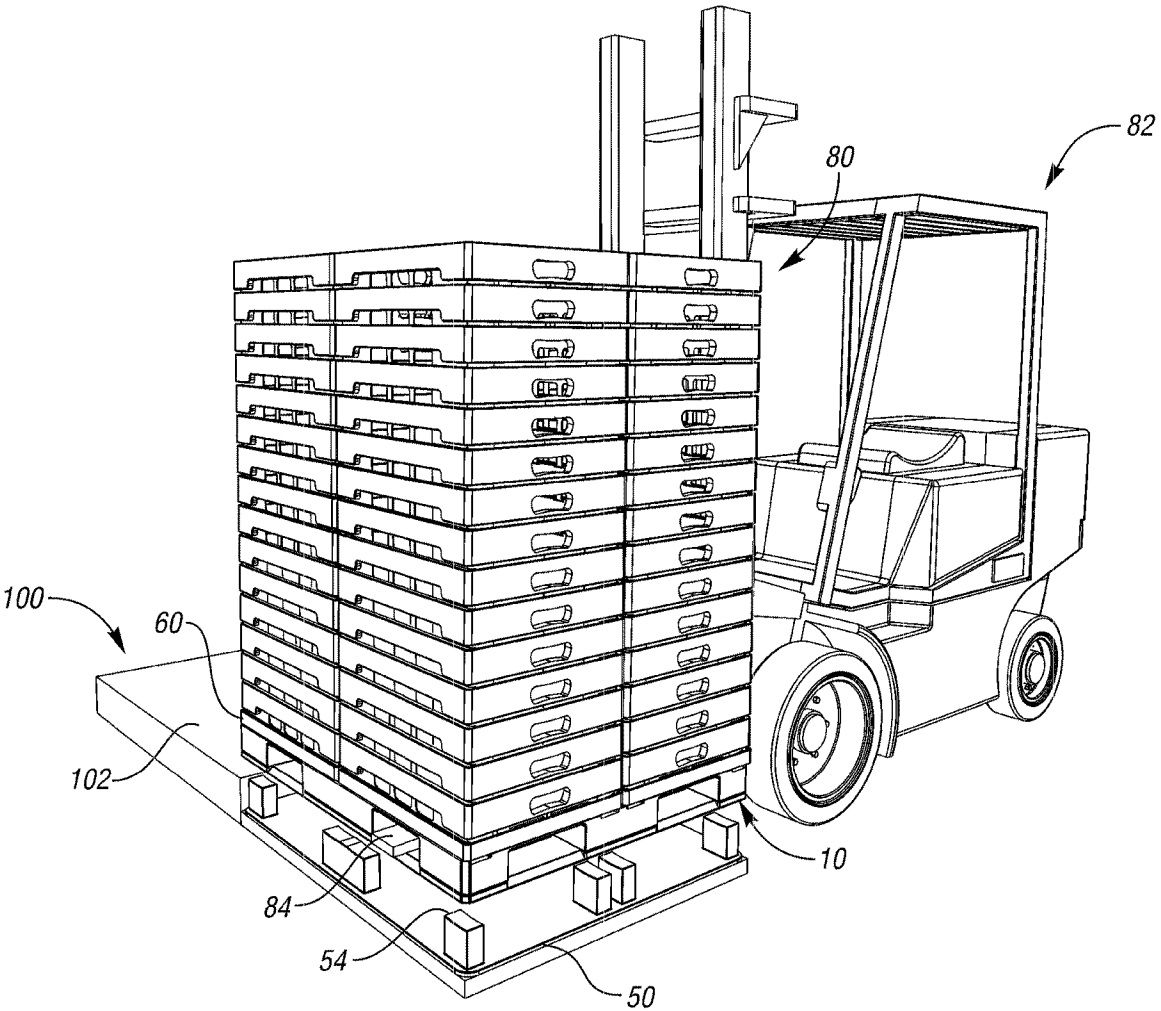
FIG. 27 illustrates a fork lift removing the pallet of FIG. 1 from the fixture adjacent the ramp of FIG. 23.

FIG. 23 illustrates the fixture 50 located adjacent a platform 100 for loading and unloading the dollies 60. The platform 100 includes an upper surface 102 that is aligned with the channels 40 in the upper deck 16 of the pallet assembly 10 to allow the casters 62 on the dollies to roll into the channels 40 and onto the pallet assembly 10. The platform 100 maintains the dollies 60 at the height of the channels 40 so that the dollies 60 do not need to be pushed up the ramp 70 to reach the pallet assembly 10 (FIG. 25) and to be removed by the fork lift 82 (FIG. 27). The dollies 60 and trays 80 could also be placed on the pallet assembly 10 with an automated system 94 that advances the trays 80 and the dollies 60 along the platform 100 as shown in FIG. 26.

The platform 100 is located adjacent only one end wall 28 of the pallet assembly 10 to allow access to the fork openings 24 on the three remaining sides of the pallet assembly 10 to raise or lower the pallet assembly 10 relative to the fixture 50.

Figure 28:
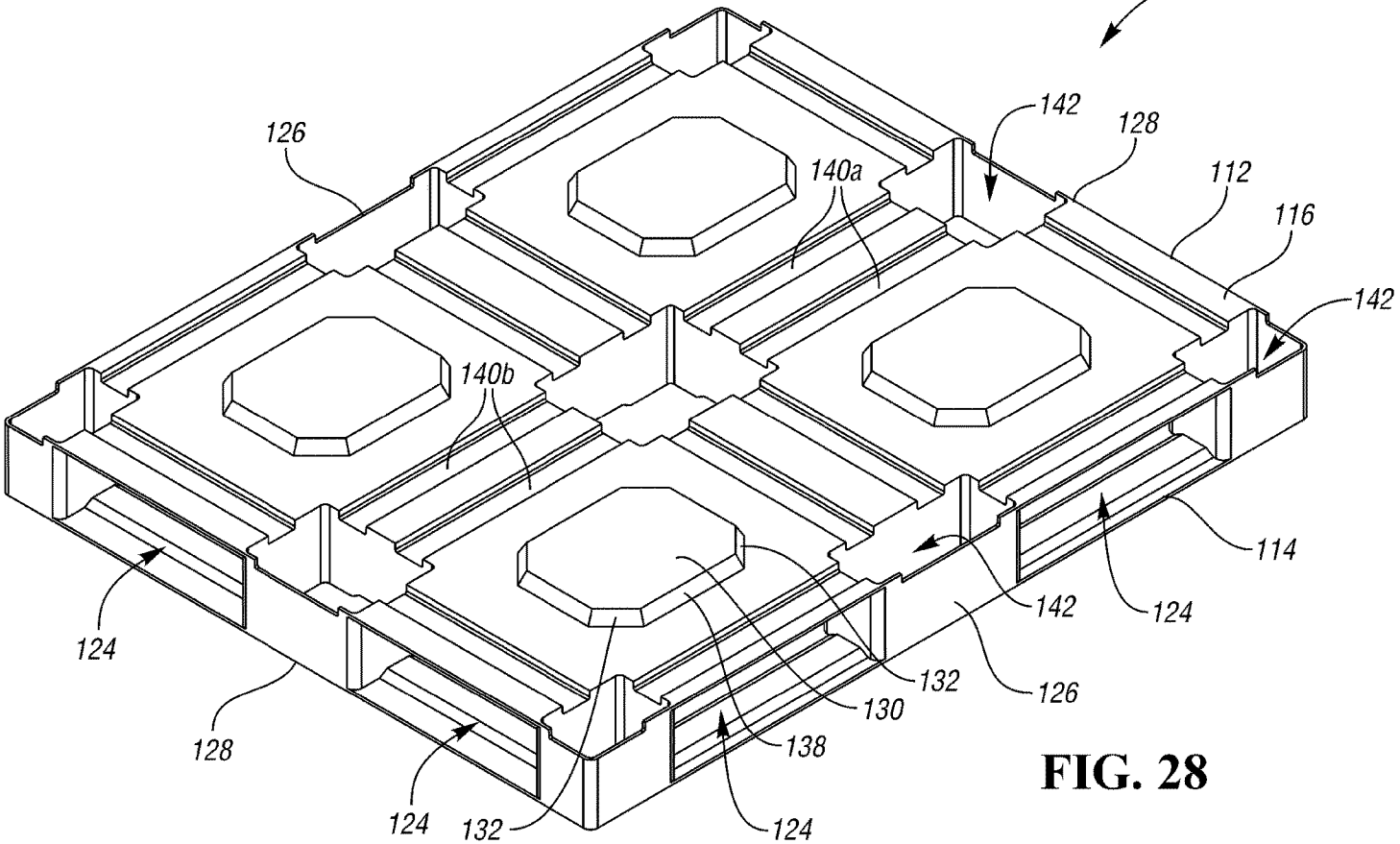
FIG. 28 is a perspective view of a pallet according to a second embodiment.

FIG. 28 illustrates another example pallet assembly 110. The pallet assembly 110 is similar to the pallet assembly 10 except where described below or shown in the Figures. The pallet assembly 110 is a single piece pallet fabricated from metal, such as steel or aluminum. The pallet assembly 110 includes an upper portion 112 and a lower portion 114 connected by columns 118 extending between the upper portion 112 and the lower portion 114. The upper portion 112 includes an upper deck 116 having an upper surface for supporting the dollies 60 thereon. The pallet assembly 110 includes a pair of opposing side walls 126 and a pair of opposing end walls 128 that each include a pair of fork openings 124 for accepting the tines 84 on the fork lift 82 to move the pallet assembly 110 relative to the fixture 50. The fork openings 124 are at least partially defined by the upper portion 112, the lower portion 114, and the columns 118.

Figure 29:
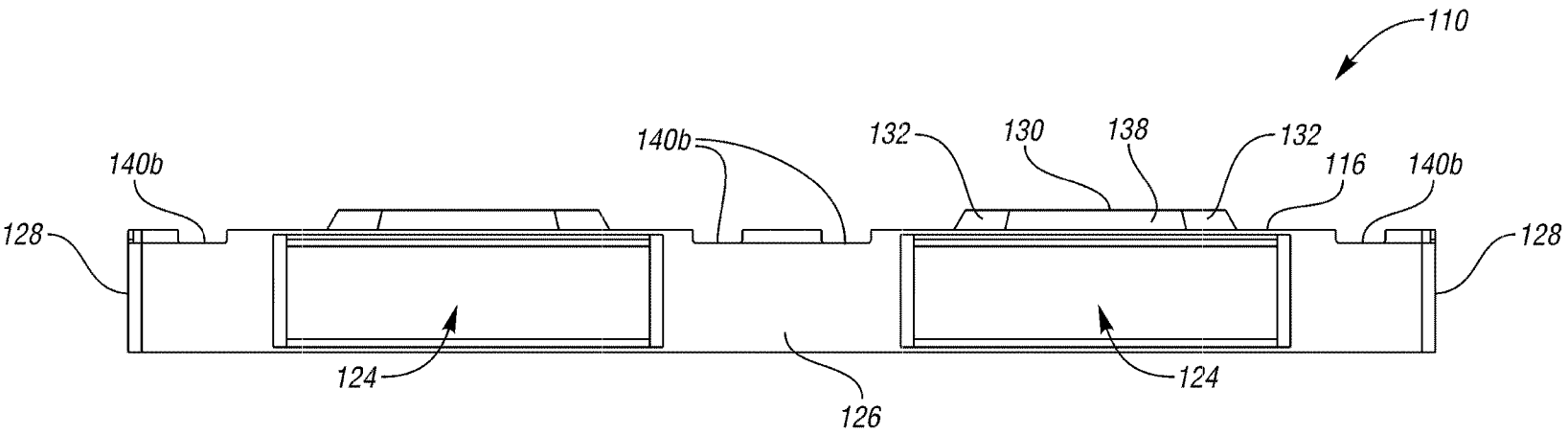
FIG. 29 is a side view of the pallet of FIG. 28.
Figure 30:
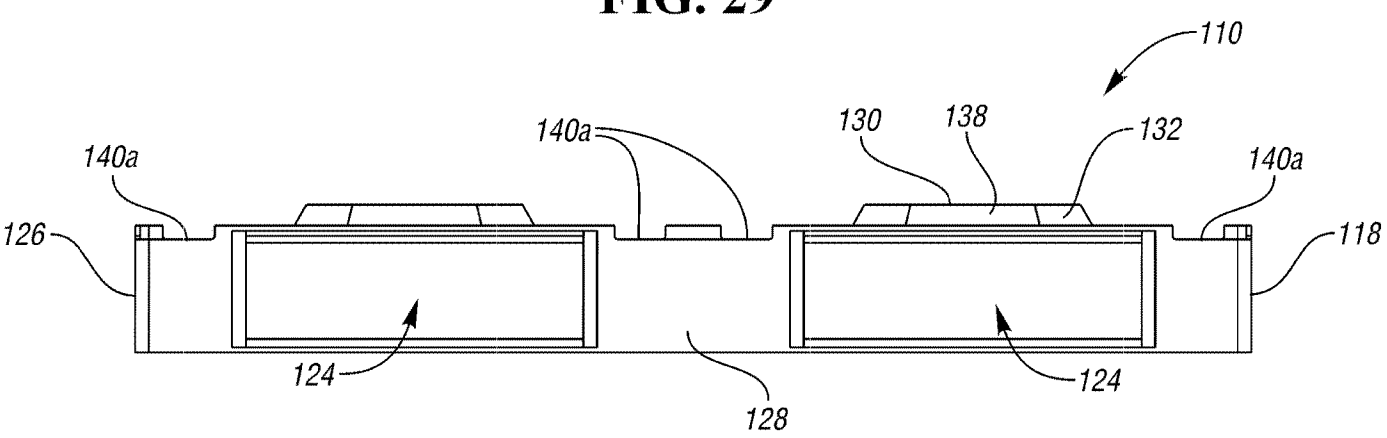
FIG. 30 is an end view of the pallet of FIG. 28.

FIG. 29 illustrates a side view and FIG. 30 illustrates an end view of the pallet assembly 110. The upper deck 116 includes a support structure 130 that extends upward from the upper deck 116 for supporting the base of the tray 80 and engaging the opening 66 in the dolly 60. As shown in FIGS. 28-30, the support structure 130 extends a first distance in the direction of the side walls 126 and a second distance in the direction of the end walls 128 with the first distance being greater than or approximately equal to the second distance. The support surface 130 includes angled corner portions 132 and an angled perimeter wall 138 between the support surface 130 and the upper deck 116.

Figure 31:
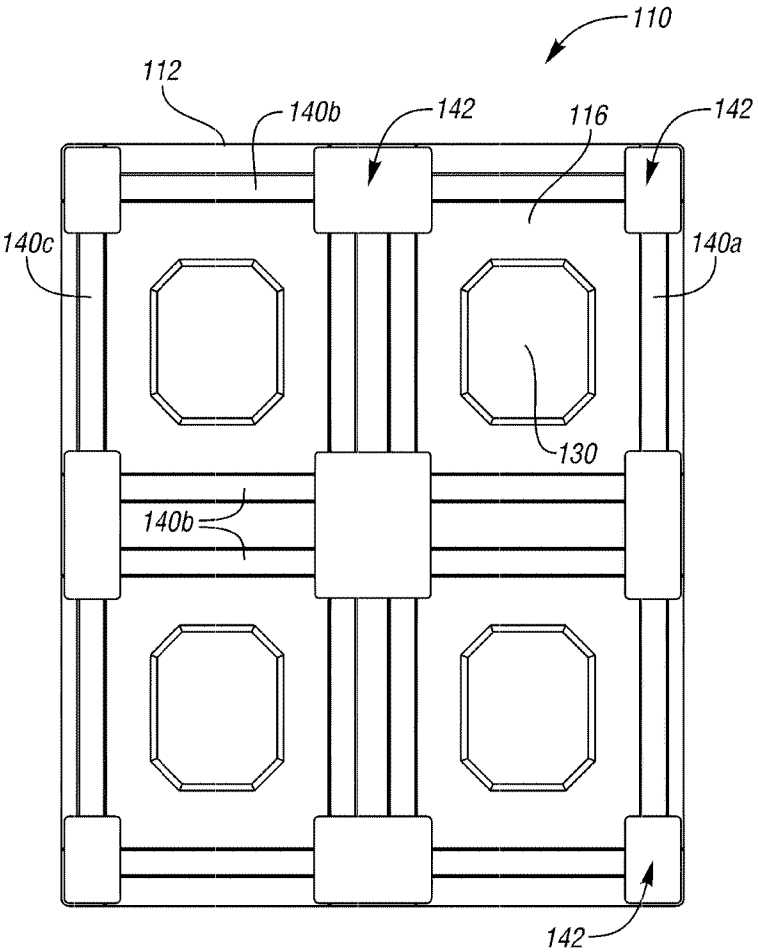
FIG. 31 is a top view of the pallet of FIG. 28.

FIG. 31 illustrates a top view of the pallet assembly 110 including longitudinal channels 140*a* and lateral structural channels 140*b* each separated by cavities 142. The longitudinal channels 140*a* extend in a direction parallel to the side walls 126 and the lateral structural channels 140*b* extend in a direction parallel to the end walls 128. The cavities 142 extend through the upper portion 112, the lower portion 114, and the columns 118 to form an opening extending through the pallet assembly 110 and discontinuities in the longitudinal channels 140*a* and lateral structural channels 140*b*. The lateral structural channels 140*b* are similar to the longitudinal channels 140*a*, but serve the primary function of increasing the structural rigidity of the upper deck 116.

Figure 32:
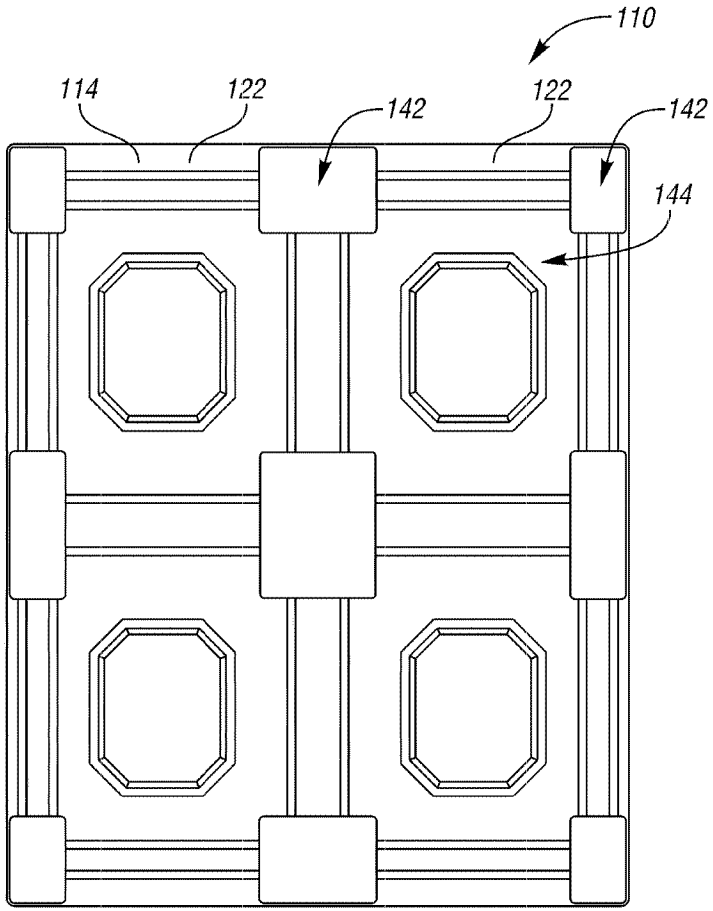
FIG. 32 is a bottom view of the pallet of FIG. 28.

FIG. 32 illustrates a bottom view of the pallet assembly 110. The cavities 142 form openings extending through the lower portion 114. Runners 122 define runner openings 144 that also extend through the lower portion 114 to reduce the weight of the lower portion 114 by reducing the amount of material in the lower portion 114 while also contributing to the rigidity of the lower portion 114.

Although a fixture is now shown in relation with the pallet assembly 110, a fixture similar to the fixture 50 could be utilized with the pallet assembly 110. Plugs on the fixture could be located within the cavities 142 in the pallet assembly 110 to fill discontinuities in the channels 140*a* and allow the casters 62 to roll onto the pallet assembly 110 freely.

Although the different non-limiting embodiments are illustrated as having specific components, the embodiments of this disclosure are not limited to those particular combinations. It is possible to use some of the components or features from any of the non-limiting embodiments in combination with features or components from any of the other non-limiting embodiments.

It should be understood that like reference numerals identify corresponding or similar elements throughout the several drawings. It should also be understood that although a particular component arrangement is disclosed and illustrated in these exemplary embodiments, other arrangements could also benefit from the teachings of this disclosure.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

What is claimed is:

1. A pallet comprising:
an upper portion including an upper surface;
a plurality of columns extending downwardly from the upper portion;
a plurality of channels extending across the upper surface of the upper portion; and
a plurality of cavities forming openings through the upper portion and a corresponding one of the plurality of columns, wherein the plurality of cavities are aligned with at least one of the plurality of channels.

2. The pallet of claim 1, wherein at least two of the plurality of cavities are located in each of the plurality of channels.

3. The pallet of claim 2, wherein the plurality of channels includes two pairs of channels extending between opposing edges of the upper portion.

4. The pallet of claim 1, wherein a first cavity of the plurality of cavities includes a first length and a second cavity of the plurality of cavities includes a second length and the second length is greater than the first length.

5. The pallet of claim 1, including a lower portion and the plurality of columns extend upward from the lower portion to the upper portion.

6. The pallet of claim 5, wherein the lower portion includes runners extending between the plurality of columns and the runners, the plurality of columns, and the upper portion at least partially define fork openings.

7. The pallet of claim 1, wherein the plurality of cavities include at least one cavity extending between adjacent channels of the plurality of channels.

8. The pallet of claim 1, wherein the pallet is a single piece metallic pallet.

9. The pallet of claim 1, wherein at least one of the openings through the upper portion and the corresponding one of the plurality of columns extends from the upper surface to a base of the corresponding one of the plurality of columns.

10. A pallet comprising:
an upper portion including an upper surface;
a plurality of columns extending downwardly from the upper portion;
a plurality of channels extending across the upper surface of the upper portion;
a plurality of cavities forming openings through the upper portion and a corresponding one of the plurality of columns, wherein the plurality of cavities are aligned with at least one of the plurality of channels; and
at least one support structure extending upward from the upper surface of the upper portion for locating a dolly stacked thereon.

11. The pallet of claim 10, wherein the at least one support structure is located between a pair of the plurality of channels.

12. The pallet of claim 10, wherein each of the plurality of channels include at least three cavities and at least two support structures located between adjacent pairs of the plurality of channels.

13. The pallet of claim 10, wherein each of the plurality of cavities are configured to receive a wheel therein.

14. A storage assembly comprising a a pallet including:

an upper portion including an upper surface;

a plurality of columns extending downwardly from the upper portion;

a plurality of channels extending across the upper surface of the upper portion; and a plurality of cavities forming openings through the upper portion and a corresponding one of the plurality of columns, wherein the plurality of cavities are aligned with at least one of the plurality of channels; and a fixture including:

an upper surface located on a first side of the fixture; and a plurality of plugs extending upward from the upper surface of the fixture, the plurality of plugs are configured to be received within a corresponding one of the plurality of cavities.

15. The storage assembly of claim 14, including a ramp having an upper surface aligned with the at least one of the plurality of channels on the pallet.

16. The storage assembly of claim 15, wherein the fixture and the pallet are both supported by the ramp.

17. The storage assembly of claim 14, wherein an upper surface of the plug is concave and configured to accept a wheel on a dolly.

* * * * *